US006505867B1

(12) United States Patent
Szablewski et al.

(10) Patent No.: US 6,505,867 B1
(45) Date of Patent: Jan. 14, 2003

(54) MOTORIZED LOCK FOR FLAPS OR DOORS IN MOTOR VEHICLES, ESPECIALLY A LOCK FOR GLOVE COMPARTMENTS

(75) Inventors: Piotr Szablewski, Wuppertal (DE); Armin Geurden, Grefrath (DE); Ulrich Müller, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/763,118

(22) PCT Filed: Aug. 12, 1999

(86) PCT No.: PCT/EP99/05919

§ 371 (c)(1),
(2), (4) Date: Feb. 16, 2001

(87) PCT Pub. No.: WO00/15932

PCT Pub. Date: Mar. 23, 2000

(30) Foreign Application Priority Data

Sep. 10, 1998 (DE) ..... 198 41 309

(51) Int. Cl.[7] ..... E05C 3/06
(52) U.S. Cl. ..... 292/201
(58) Field of Search ..... 292/51, 199, 201

(56) References Cited

U.S. PATENT DOCUMENTS

| | | | | | |
|---|---|---|---|---|---|
| 4,624,491 | A | | 11/1986 | Vincent | |
| 4,763,936 | A | * | 8/1988 | Rogakos et al. | 292/13 |
| 5,007,261 | A | * | 4/1991 | Quantz | 292/201 |
| 5,180,198 | A | * | 1/1993 | Nakamura et al. | 292/201 |
| 5,232,253 | A | * | 8/1993 | Tamiya | 292/201 |
| 5,411,302 | A | * | 5/1995 | Shimada | 292/201 |
| 5,474,338 | A | * | 12/1995 | Buscher | 292/199 |
| 5,577,782 | A | * | 11/1996 | Johnson et al. | 292/201 |
| 5,639,130 | A | * | 6/1997 | Rogers et al. | 292/199 |
| 5,713,613 | A | * | 2/1998 | Honma et al. | 292/201 |
| 5,762,384 | A | * | 6/1998 | Bartel | 292/201 |

FOREIGN PATENT DOCUMENTS

| | | |
|---|---|---|
| DE | 195 17 442 A1 | 11/1996 |
| DE | 195 30 722 A1 | 2/1997 |
| WO | 9728337 | 8/1997 |

* cited by examiner

*Primary Examiner*—Robert J. Sandy
*Assistant Examiner*—Dinesh N Melwani
(74) *Attorney, Agent, or Firm*—Friedrich Kueffner

(57) ABSTRACT

The invention relates to a lock that can be used with a flap, comprising a rotary unit that is made up of a rotary spagnolet that interacts with a closing element (10) and a rotating latch (22). In order to improve operational performance, the rotary unit is provided with a rigid catch (23) that preferably has two counter shoulders running in opposite directions. The output member (35) of a motor (40)—driven gear mechanism is also provided with two corresponding counter shoulders. This enables the motor to provide assistance with closing and, optionally, opening, whereby the rotary unit can be guided in a closing, tilting direction or an opening, tilting direction until the flap is fully closed or opened. The motor (40) comprises a gear mechanism with a group of gears that can be displaced between an engaged position and a separated position. The detent pawl (16) which interacts with the rotating latch (22) is disabled in the separated position, should an emergency arise. When the flap is in a closed or open position, a free area exists between the shoulders and counter shoulders, enabling the flap to be moved manually.

5 Claims, 8 Drawing Sheets

MOTORIZED LOCK FOR FLAPS OR DOORS IN MOTOR VEHICLES, ESPECIALLY A LOCK FOR GLOVE COMPARTMENTS

BACKGROUND OF THE INVENTION

1. Field of the Invention

The invention relates to a motorized lock for flaps or doors of motor vehicles, especially a lock for a glove compartment.

2. Description of the Related Art

The motorized lock of the aforementioned kind has a rotary spagnolet in which, during closing of the flap, a locking member is inserted and rotates the rotary spagnolet out of an open pivot position, characterizing the open position of the flaps via a split position of the flap into a closed position determining the locked position of the flap, with a locking pawl having a rotating latch connected rotationally fixedly to the rotary spagnolet when the locking pawl is active and when the rotary unit, comprised of the rotary spagnolet and the rotating latch, has been transferred out of its open pivot position, with the flap in the open position, either into a pre-locking position determining the split position of the flap or into a closed pivot position defining the locked position of the flap.

SUMMARY OF THE INVENTION

Even though for locks of different kinds motor-driven closing and opening aids are known, these are not suitable for a lock of the kind mentioned in the preamble. According to the invention, a motor is used as a closing and, if needed, also an opening aid wherein a special gear mechanism acts via shoulders onto correlated counter shoulders of a catch. The catch is a component of a rotary unit which, in addition to the catch, also comprises a rotating latch cooperating with a locking pawl and a closing member cooperating with a rotary spagnolet. The gear mechanism has a position-changeable gear group which, relative to the rest of the gear mechanism, is adjustable between an engagement position and a separating position. In the closed or open position of the flap the rotary unit is in a final locking position or an initial position but the drive member of the gear mechanism having the shoulders is always transferred into a defined ready position. In it a free space is provided between the shoulders and the counter shoulders so that the flap can be easily opened or closed manually. In this connection, the gear mechanism is in a separating position so that a possible self locking action in the drive chain between the motor and the drive member is canceled. The flap can be manually moved farther in any intermediate position in which an emergency situation occurs.

BRIEF DESCRIPTION OF THE DRAWINGS

Further features and advantages of the invention result from the claims, the following description, and the drawings. In the drawings, an exemplary embodiment of the invention is illustrated. It is shown in:

FIGS. 5 through 8*a,* in a representation corresponding to FIG. 4*b,* three further positions of the lock parts which result during closing of the flap provided with a closing member of this lock, wherein FIG. 8*a* shows the ready position of the lock parts for opening when the flap is closed;

DESCRIPTION OF PREFERRED EMBODIMENTS

Figure 1:
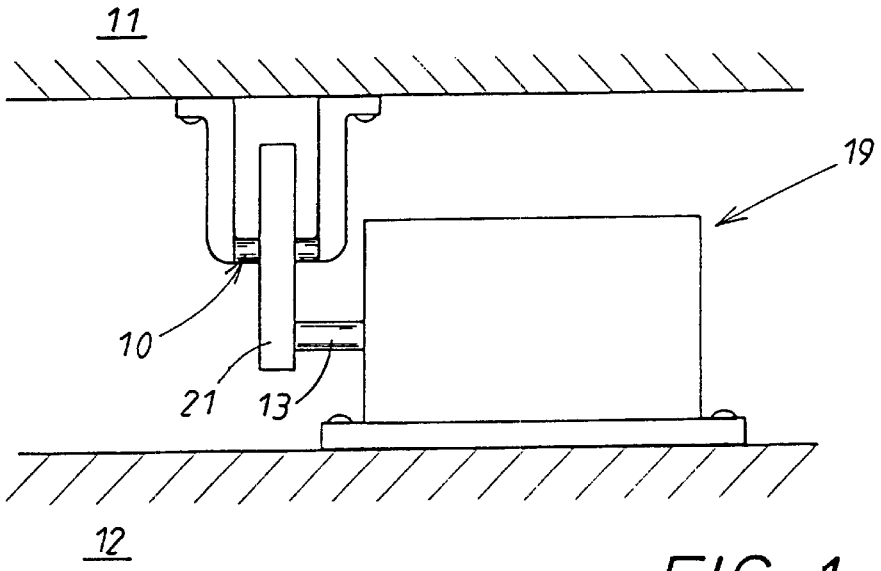
FIG. 1 a schematic view of the lock according to the invention.

The lock illustrated in the Figures is used preferably for a flap which belongs to a glove compartment. Accordingly, in FIG. 1 the movable flap 11 and the stationary compartment rim 12 are illustrated schematically. In the present case the movable flap 11 supports the frame with a closing member 10, here in the form of a bolt with a round cross-section while the compartment rim 12 has a lock housing 19 from which the rotary latch 22 projects which cooperates with the closing member 10. It is understood that the lock parts 10, 19 can also be arranged mirror-symmetrically relative to the movable and stationary elements 11, 12 of the glove comfort and.

The most important lock parts provided in the lock housing 19 are illustrated in FIGS. 2 to 4*b*. In the lock housing 19 an axle shaft 13 is rotatably supported which forms a component unit 20 of several components 21 to 23 which are fixedly connected to one another. The component 20 is thus a part which is rotatable in its entirety and is therefore in the following referred to as a rotary unit. This rotary unit 20 includes first the fork-shaped rotary spagnolet or latch member 21 whose fork opening during closing of the flap, according to the movement arrow 15 illustrated in FIG. 4*a,* is engaged by the closing member 10. At an axial spacing thereto in the interior of the lock housing 19 a rotating latch 22 is provided which has a pre-locking stage 24 and a final locking stage 25 for a pivotable locking pawl 16. The locking pawl 16 is spring-loaded in the direction of arrow 17 in the direction toward the rotating latch 22. Moreover, the entire rotary unit 20 is spring-loaded in the direction of opening of the rotary spagnolet 21 as illustrated in FIG. 4*a* via the force arrow 27. The fully open position of the rotary spagnolet 21 illustrated in FIG. 4*a* is limited by a schematically indicated stop 26 in the housing against which the spring load 27 normally forces the rotary spagnolet 21. This open pivot position is present in the open position of the flap.

In the lock housing 19 a gear mechanism 30 acted on by an electric motor 40 is positioned. The gear mechanism 30 comprises several gear groups of which one special gear group 36 can be position-changed, in particular, in the present case by tilting as can be seen when comparing FIGS. 2 and 3. The input member of the gear mechanism 30 is a worm driven by the motor 40 and engages a worm wheel 31. The worm wheel 31 is connected fixedly with spur gears 32 and is freely rotatable on the axle shaft 13. The spur gear 32 meshes with a gear 33 which is seated fixedly on the pinion 34. The component group 36 of the gear mechanism parts 33, 34 has a shaft 14 which in a first type of application of the lock, extends normally parallel to the axle shaft 13. In this case, the pinion 34 meshes with the drive member 35 of the gear mechanism 30 which is also formed as a spur gear. Accordingly, the gear group 36 is in an active engagement position where the rotation exerted by the motor 40 is transmitted onto the drive member 35.

Figure 3:
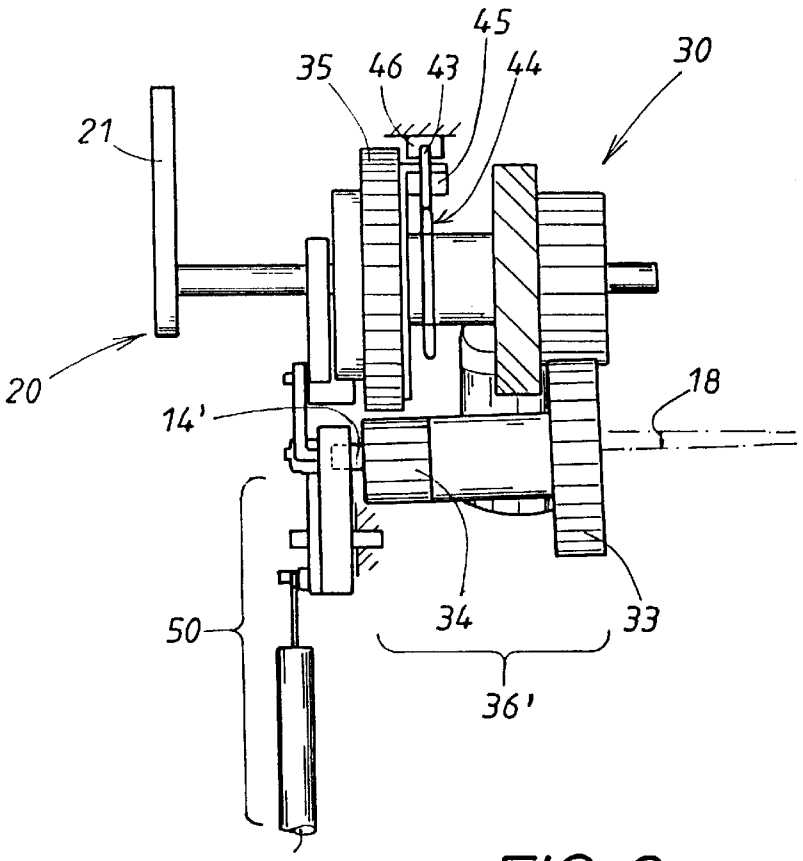
FIG. 3 the side view according to FIG. 2 with the lock parts in a second position.
Figure 2:
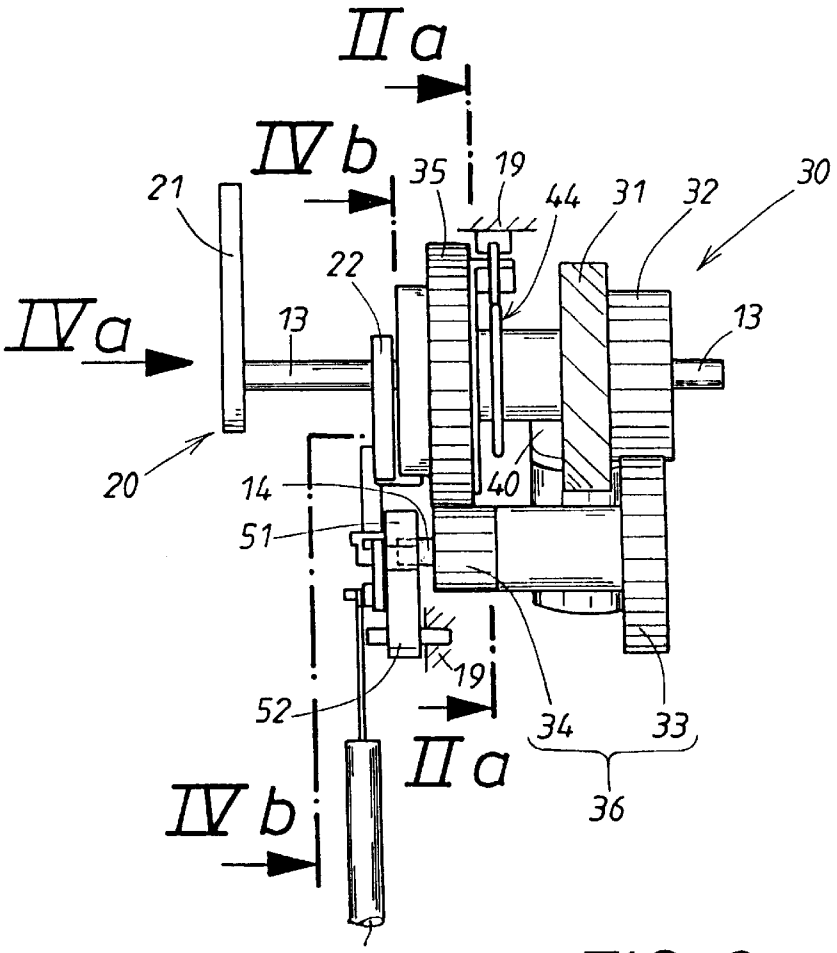
FIG. 2 in a side view essential components of the lock in a first position.

As illustrated in FIG. 3, the component group 36 can be moved into a tilted position 36' by an actuator 50 comprising several members which tilted position is pivoted by an angle 18 according to FIG. 3 and in which the pinion 34 engages no longer the toothing of drive member 35. The self locking action of the gear mechanism 30 is canceled. The tilted position 36' of this gear group can be referred to as "separating position".

Figure 2A:
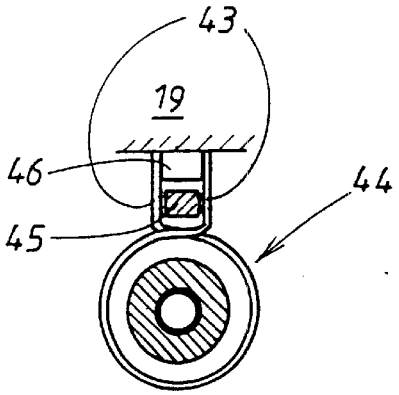
FIG. 2*a* a cross-section of a part of the lock of FIG. 2 along the indicated section line IIa—IIa.
Figure 2B:
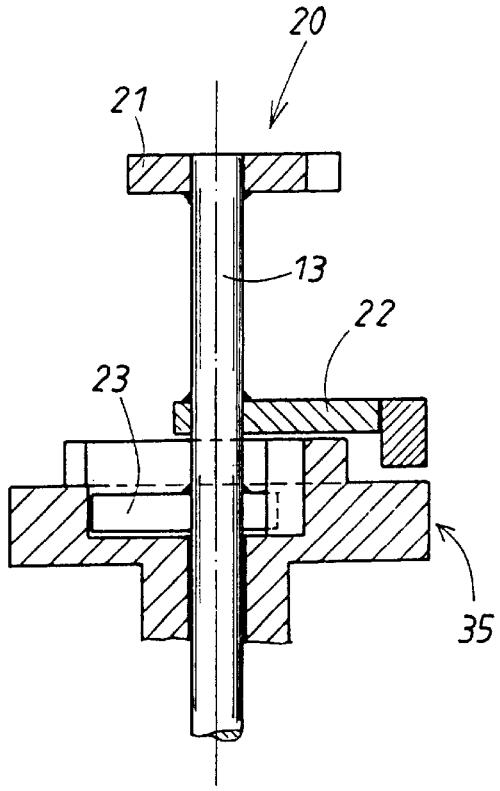
FIG. 2*b* an axial section along the section line IIb—IIb, indicated in FIG. 4, of a part of the lock with broken-away portions.
Figure 4B:
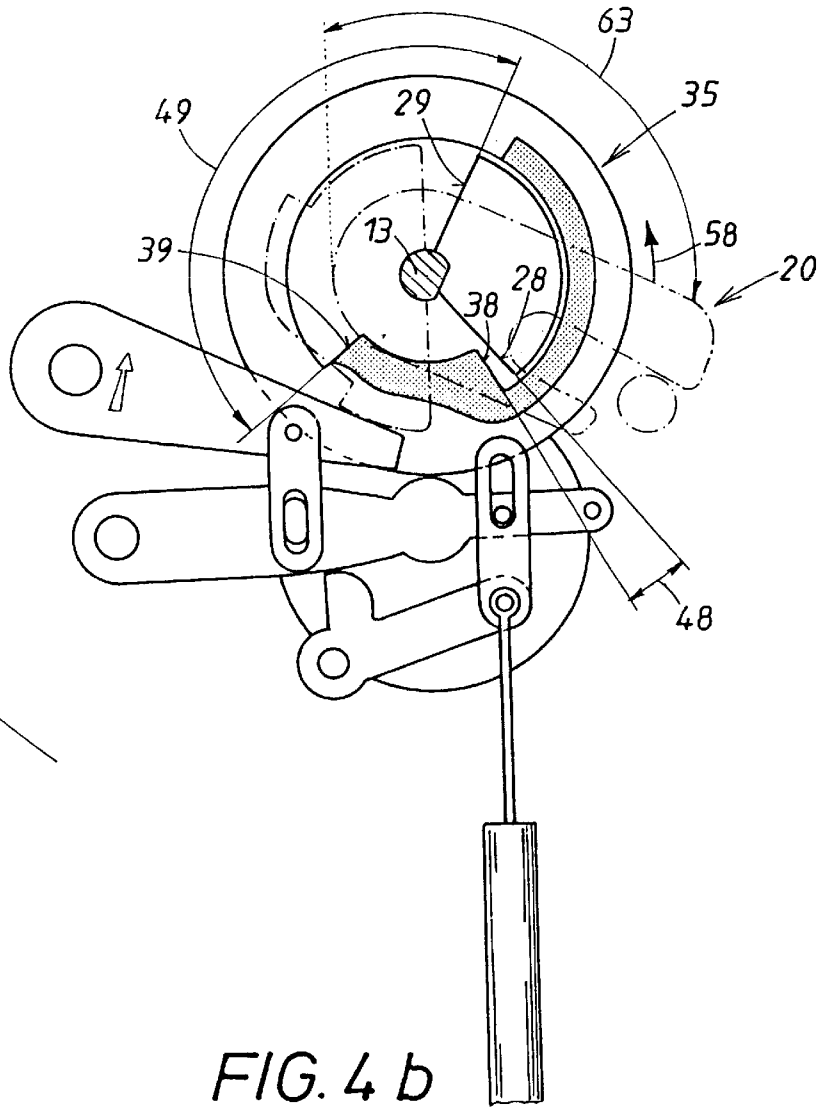
FIG. 4*b* a plan view corresponding to that of FIG. 4*a,* wherein the two uppermost components of a rotary unit belonging to the lock, i.e., a rotary spagnolet and a rotating latch, cannot be seen but are illustrated by a dash-dotted line, which view corresponds to a section taken along the section line VIb—VIb of FIG. 2.

The drive member 35 is hollow as can be seen best in FIG. 2*b* and serves for receiving the catch 23 of the rotary unit 20. The drive member 35 is provided with an axial cam 37 whose axial end face is enhanced for illustration purposes in FIGS. 4*a* through 13 by dotted shading. This cam 37 defines a radial control surface 47. Moreover, the drive wheel 35 has two shoulders 38, 39 which can be seen in FIG. 4*b* and which have correlated therewith two counter shoulders 28, 29 on the rotating latch 22. The two shoulders 38, 39 of the drive member 35 as well as the two counter shoulders 28, 29 are opposite relative to one another, respectively, as can be seen in FIG. 4*b*. It is important in this connection that between the shoulder and the counter shoulder 28, 38 an angle-shaped free space 48 is provided. A corresponding free space 49 is also provided between the other pair 39, 29 of the two shoulders and counter shoulders.

Figure 4A:
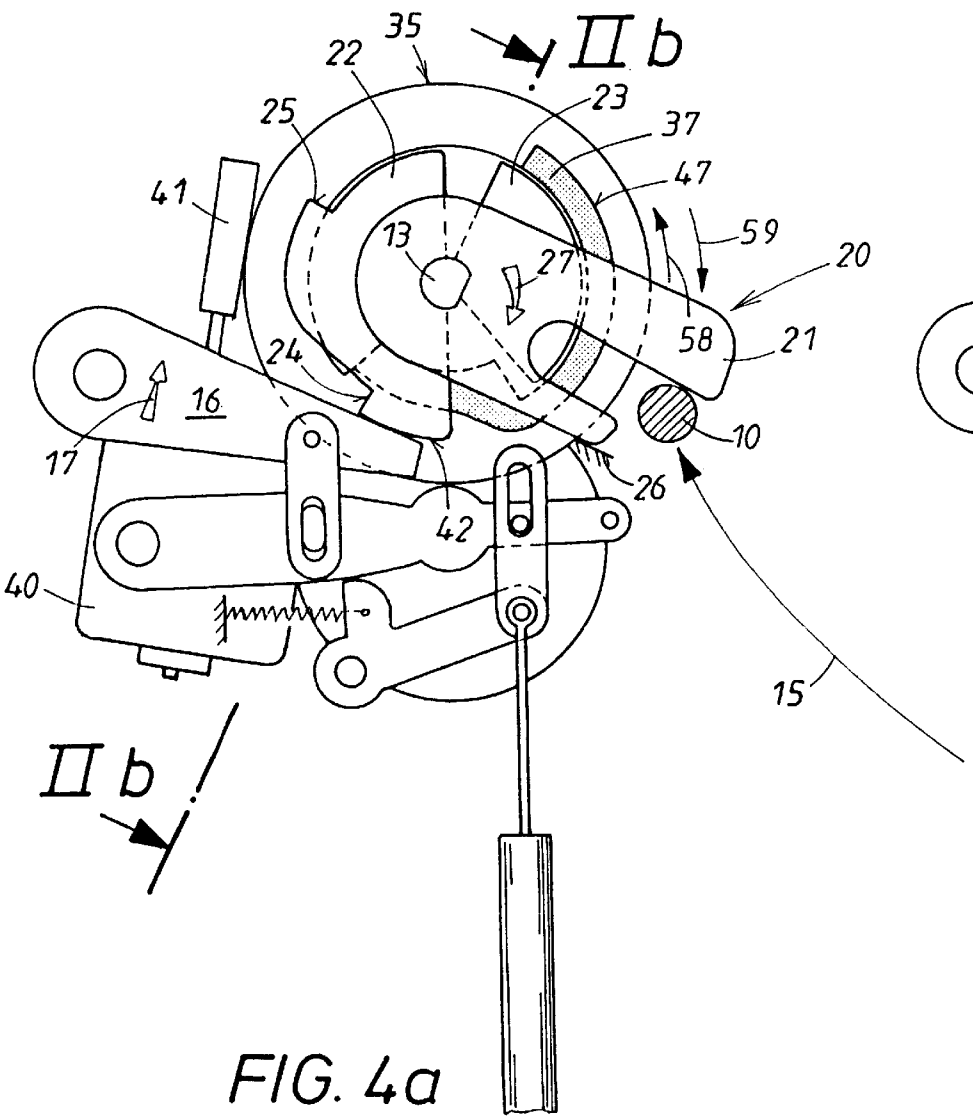
FIG. 4*a* the axial plan view onto the lock and the viewing direction of arrow VIa of FIG. 2 with the lock parts in a ready position for closing a flap.

In FIGS. 4*a,* 4*b* the drive member 35 is in a ready position for closing the flap which is in its fully open position. In the ready position of FIG. 4*a,* the locking pawl 16 is supported as a result of the aforementioned spring loading 17 at the peripheral surface 42 of the rotating latch 22. The flap is moved first manually in the direction of its closed position wherein the locking bolt 10 provided on it is moved in the direction of the already mentioned arrow 15 and thus impacts on the rotary spagnolet 21 and thus entrains it. First, a manual closing pivot movement of the rotary spagnolet 21 in the direction of arrow 15 of FIG. 4*a* takes place wherein the entire rotary unit 20, i.e., including the catch 23, is pivoted against the spring load 27. The counter shoulder 28 thus moves away increasingly from the shoulder 38 belonging to the drive member 35. The drive member 35 remains in the rest position until the position of the rotary unit 20 illustrated in FIG. 5 has been reached.

Figure 6:
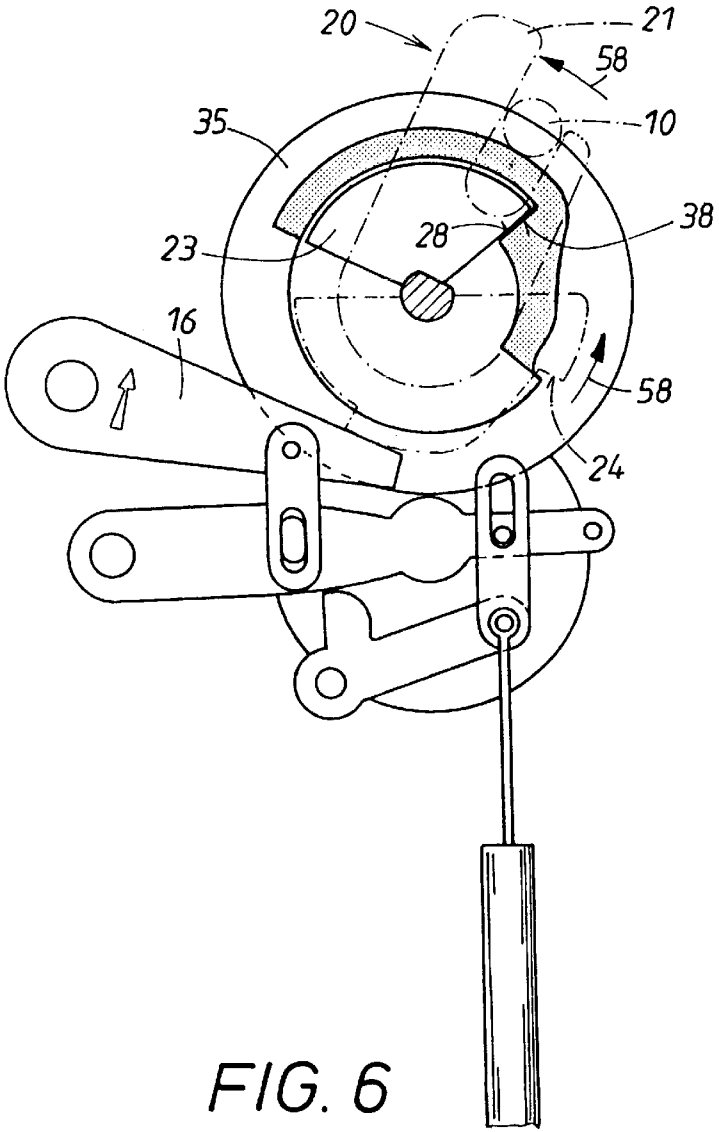
Figure 5:
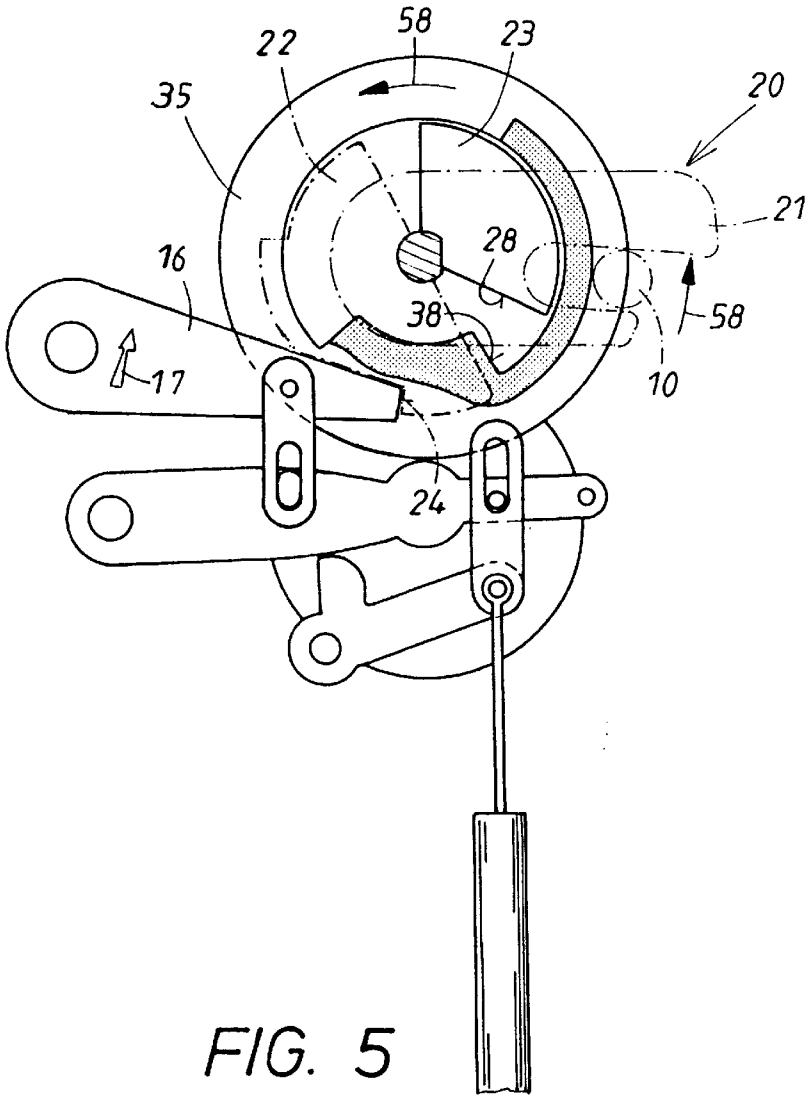

In FIG. 5, the rotary unit 20 is in a so-called pre-locking position where the pawl 16 has dropped, as a result of its spring load 17, into the pre-locking stage 24 of the rotating latch 22 illustrated in a dash-dotted line. In this case, a "split position" of the flap is present. In FIG. 5, as a result of the manual movement 58 the counter shoulder 28 has moved away from the shoulder 38 to a maximum degree. This pre-locking position is detected by sensors which now supply current to the motor 40. Via the gear mechanism 30 the drive member 35 is now rotated father in the direction of closing 58 of FIG. 5. Now the shoulder 38 of the drive wheel 35 impacts on the counter shoulder 28 of the catch 23. Accordingly, the entire rotary unit 20 is pivoted, as illustrated in FIG. 6. In this connection, the pre-locking stage 24 of the rotating latch 22 moves away from the spring-loaded locking pawl 16. Since the locking bolt 10 has been moved already sufficiently into the fork opening of the rotary spagnolet 21, it is now entrained by the closing pivot movement 58 of the rotary spagnolet 21 so that the flap now is closed by motor drive action.

Figure 7:
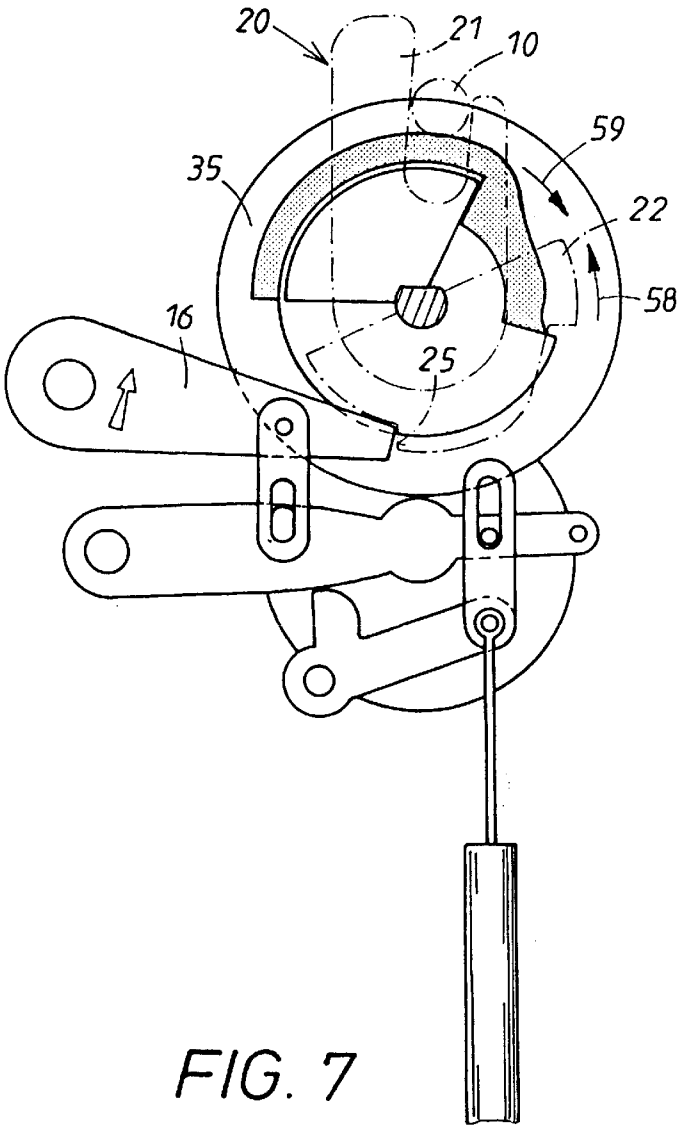

In FIG. 7 the motor-driven closing pivot movement 58 is completed via the drive member 35. The rotary unit 20 with its rotary spagnolet 21 is now in a final locking position. The locking pawl 16 has dropped into the final locking stage 25 of the rotating latch 22. This is now detected by sensors which slow down the motor. Moreover, in this type of application the rotary direction of the motor is reversed; a reverse rotation results by which, via the gear mechanism 30, the drive wheel 35 is first rotated back in the opening pivot direction according to arrow 59 of FIG. 7. This return rotation however does not include the rotary unit 20. The rotary spagnolet 21 and the locking bolt 10 engaged by it remain in the completely closed pivot position and secure the locking bolt 10. Accordingly, the completely closed position of the flap is secured.

Figure 8B:
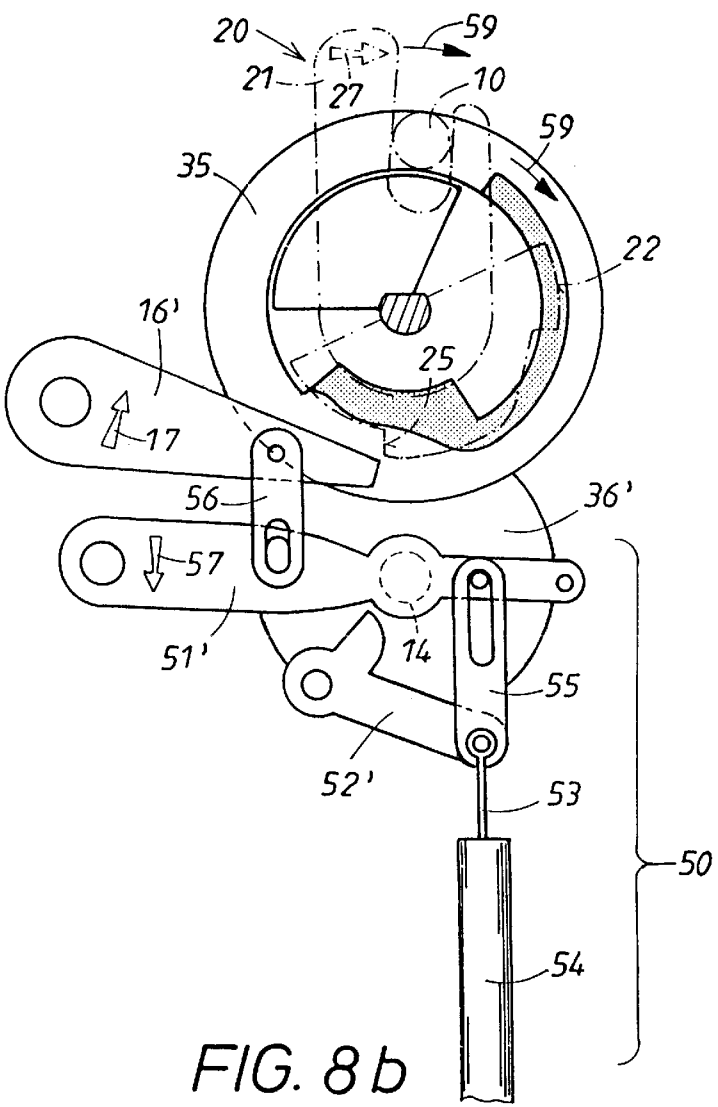
FIG. 8*b* shows the same rotational position of the lock parts as FIG. 8*a* but in an emergency situation for a manual opening of the flap or for illustrating an alternative function of this lock.
Figure 8A:
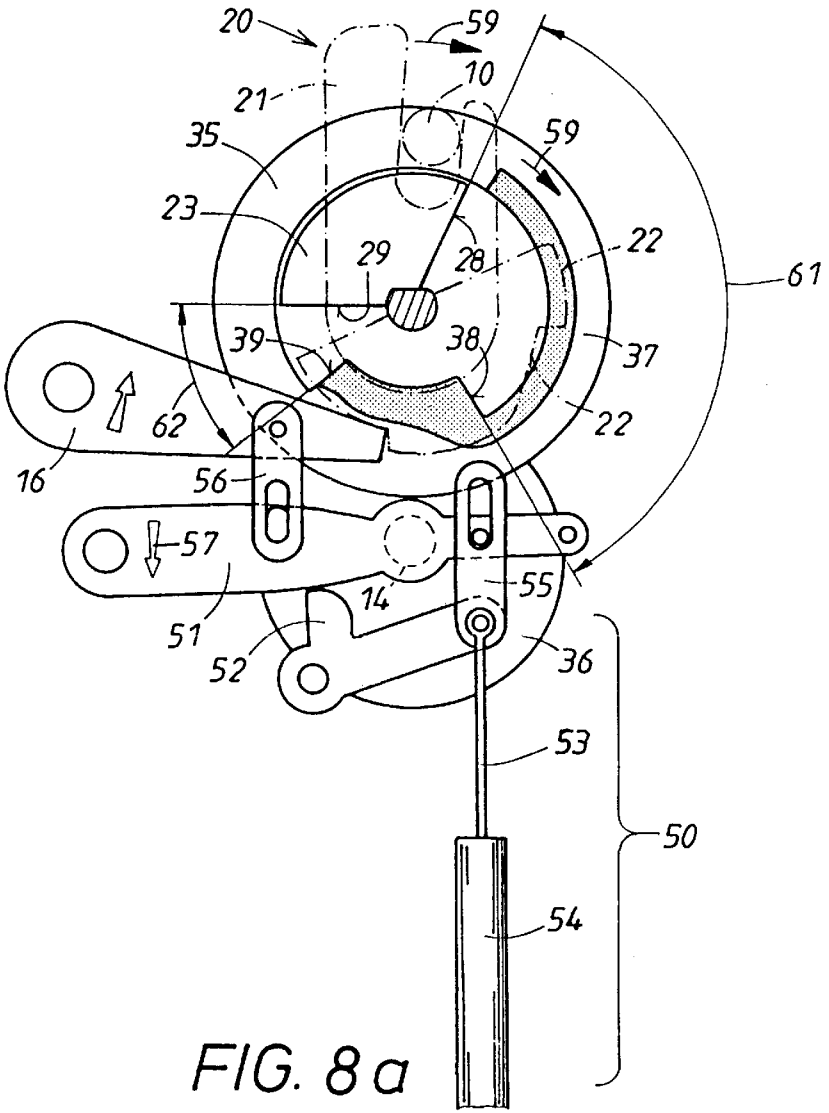

The latter remains in place when the drive member 35 finishes its return rotation in the direction 59 of the opening pivot direction according to FIG. 8*a.* This can be detected and triggered by sensors. In this position, the shoulder 38 of the drive member 35 has moved away from the counter shoulder 28 of the catch 23. A large free space defined by the angle 61 in FIG. 8*a* is present therebetween. Also, between the shoulders and counter shoulders 39, 29, not yet active at this point, a free space defined by the angle 62 is provided. The same rotational position of the drive member 35 as in FIGS. 4*a,* 4*b* is presented as illustrated with the aid of the position of the cam 37 shown in dotted shading. The position of the rotary unit 20 however is opposite; while in FIGS. 4*a,* 4*b* the completely open initial position is present, the rotational unit 20 in FIG. 8*a* is shown in its completely closed final locking position. In FIG. 8*a* the drive member 35 is again in its ready position, as in FIGS. 4*a,* 4*b;* however, for opening the flap in the direction of the opening arrow 59 illustrated on the rotary spagnolet 21. The manual opening of the flap, however, is initially not possible because the drive member 35 engages the other members of the gear mechanism 30, and between these members a self locking action is present. Primarily, the movement in the opening pivot direction 59 is prevented because of the locking pawl 16 securing the rotary unit 20 by means of the rotating latch 22 in the final locking position illustrated in FIG. 8*a.* In this type of application of the invention, a motor-driven opening movement is therefore provided, as will be explained in more detail with FIG. 9.

An emergency situation may now occur where, in the ready position of FIG. 8 or in any of the preceding or following intermediate positions of the drive member, the current supply fails and a motor-driven opening of the flap is impossible. The invention makes possible a manual opening movement by activating the special actuator 50, already mentioned in connection with FIG. 3, and this will be explained in FIG. 8*b* in more detail.

The actuator comprises first a working lever 51, illustrated in FIGS. 8*a* and 8*b,* which, as illustrated in dashed lines, supports the tiltable end of the axle 14 of the indicated gear group 36. In the normal situation according to FIG. 8*a,* the working lever 51 is secured by a support lever 52 so that in connection with FIG. 2 the already described engagement position 36 of this component group is present. The actuator 50 is triggered by a manual grip, not shown, which acts on a pull cable 53, illustrated with its end part in FIGS. 8*a,* 8*b,* of the Bowden cable 54. The pull cable 53 engages the support lever 52 which can be transferred from its active position 52 illustrated in FIG. 8*a* into its inactive position 52' illustrated in FIG. 8*b*. The working lever in this connection is under the action of a lifting spring illustrated by the force arrow 57 which in the case of the working lever illustrated in FIG. 8*b* is pivoted into the pivoted-away position 51'. By doing so, the gear group reaches the tilted position, shown in FIG. 3 and illustrated by the end of the axle 14, which tilted position characterizes the separating position of the gear mechanism 30. The gear mechanism 30 is decoupled so that the self locking action is canceled. The drive member 35 can therefore be moved without motor in the direction of the arrow 59 in the opening pivot direction as illustrated in FIG. 8*b*. This is automatically carried out in this situation by means of a return spring 44, illustrated in FIGS. 2, 2*a,* which engages with its two spring legs 43 two pins 45, 46 and ensures their radial alignment according to FIG. 2*a*. One pin 45 is seated on the drive member 35, while the other pin 46 is fastened to the housing, i.e., is positioned in the interior of the lock housing 19 indicated in FIGS. 2*a* and 2. As indicated in FIG. 8*b,* the pivoting-away movement of the working lever into its pivoted-away position 51' is realized by a coupling rod 55 in correlation with the support lever which then acts in its inactive position 52'.

A slotted hole guiding action or the like then provides for an adjustment of the pivot movement path resulting therefrom. There is a further coupling rod 56 between the locking pawl 16 and the working lever 51 so that here a suitable longitudinal guiding also provides for an adjustment of the movements. By means of the further coupling rod 56, according to FIG. 8*b,* via the working lever having been moved into the pivoted-away position 51', an adjusted pivoting-away movement of the locking pawl 16 is realized which, from its active engagement position in the rotating latch 22 according to FIG. 8*a,* is pivoted into an inactive release position 16' of FIG. 8*b* counter to its spring load 17. Subsequently, the rotating latch 22 is no longer blocked in its final locking stage 25. The entire rotary unit 20 is free and can thus be moved in the direction of opening arrow 59. This can be realized by the action of the afore described return spring 44. Moreover, the rotary spagnolet 22 of the rotary unit 20 is subjected to the action of the spring force 27, already mentioned in connection with FIG. 4*a,* which is active in the same direction 59. Accordingly, the rotary spagnolet 21 can again be fully open until it reaches the ready position illustrated in FIG. 4*a*. This opening movement 59 releases the locking bolt 10, and the flap is now in its fully open position.

The aforementioned cancellation of the self locking action of the gear mechanism by the separating position 36 of the gear group is important primarily when the emergency situation which caused the triggering of the actuator 50 has happened in the afore described intermediate positions according to FIGS. 6 or 7. The automatic return of the rotary unit 20 resulting from the spring force is not possible in the direction of opening direction 59 because upon its return rotation the catch 23 impacts with a counter shoulder 28 against the shoulder 38 belonging to the drive member 35. This is not the case in the situation of FIG. 8*a* which, as mentioned above, is identical to FIG. 8*b*. As has been mentioned above, the drive member 35 with its shoulders 38, 39 is already in a position which coincides with the open position of FIGS. 4*a,* 4*b*. The aforementioned free space 61 is large enough in order to return the rotary unit 20 into its initial position of FIG. 4*a*. Normally, this is carried out in this embodiment of the invention by a motor drive with the above-mentioned return rotation of the drive member 35 in the opening pivot direction 59 without the previously described triggering of the actuator 50 having to take place.

Figure 9:
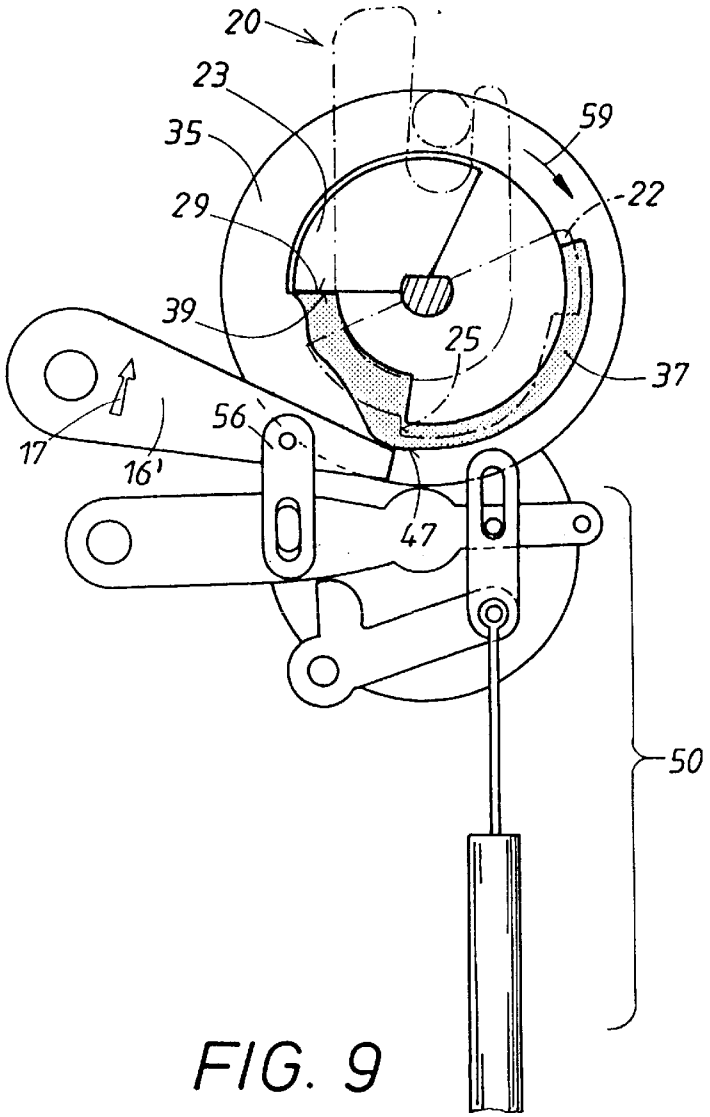
FIGS. 9 through 12 the lock parts in four further rotary positions which result for a motor-driven opening of the flap.

For a corresponding switching on of the motor 40, for example, an electrical key is provided. When moving the drive wheel 35 in the direction of arrow 59 according to FIG. 9, the shoulder 39 of the cam 37 has moved onto the counter shoulder of the catch 23. At the same time, the cam 37 with its control surface 47, as illustrated in FIG. 9, has been moved against the locking pawl and has pivoted it into the aforementioned inactive position 16' against the spring load. This pivoting action is without any feedback action on the aforementioned actuator 50 because the slotted hole guide is provided in the mentioned coupling rod 56. This slotted hole guide makes the adjusting movement at the locking pawl by the control surface 47 possible, without action on the actuator 50. The rotary unit 20 is no longer blocked by the locking pawl.

Figure 10:
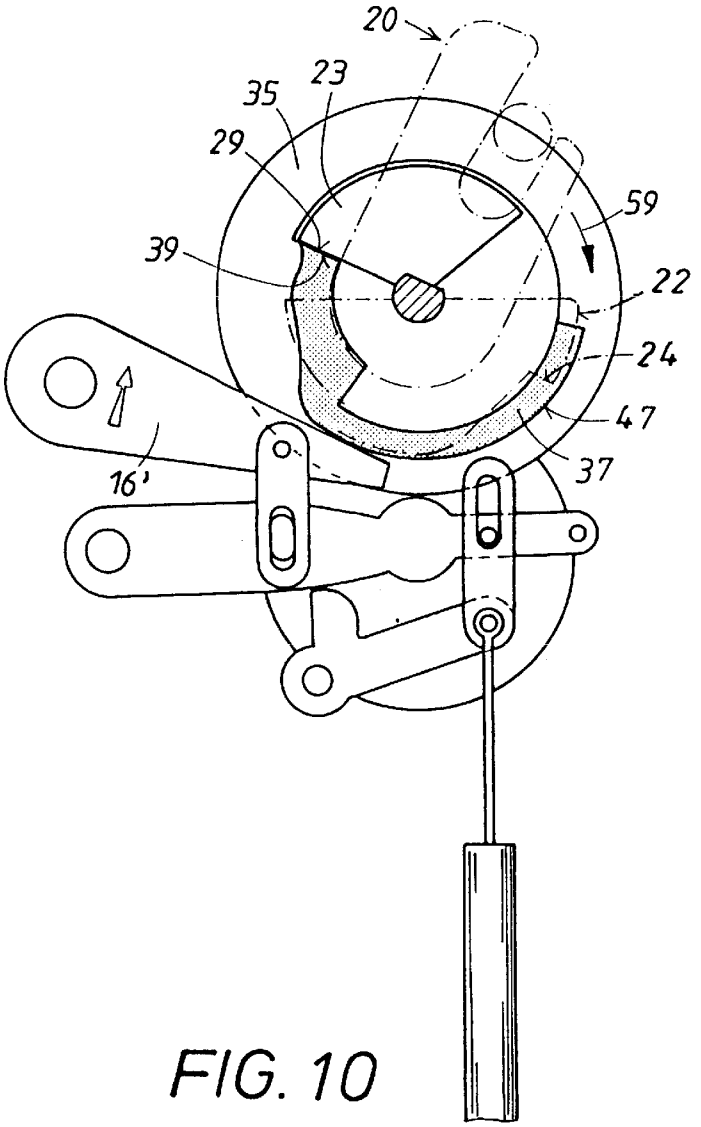

According to FIG. 10, the rotary unit 20 is further moved by the shoulder 39 of the drive motor 35. by means of the counter shoulder 29 of the catch 23. In this connection, the control surface 47 provided on the cam 37 maintains the locking pawl still in its inactive position 16' so that an undesirable dropping into the subsequent pre-locking stage 24 of the rotating latch 22 is prevented upon further rotation 59 initiated by the motor.

Figure 11:
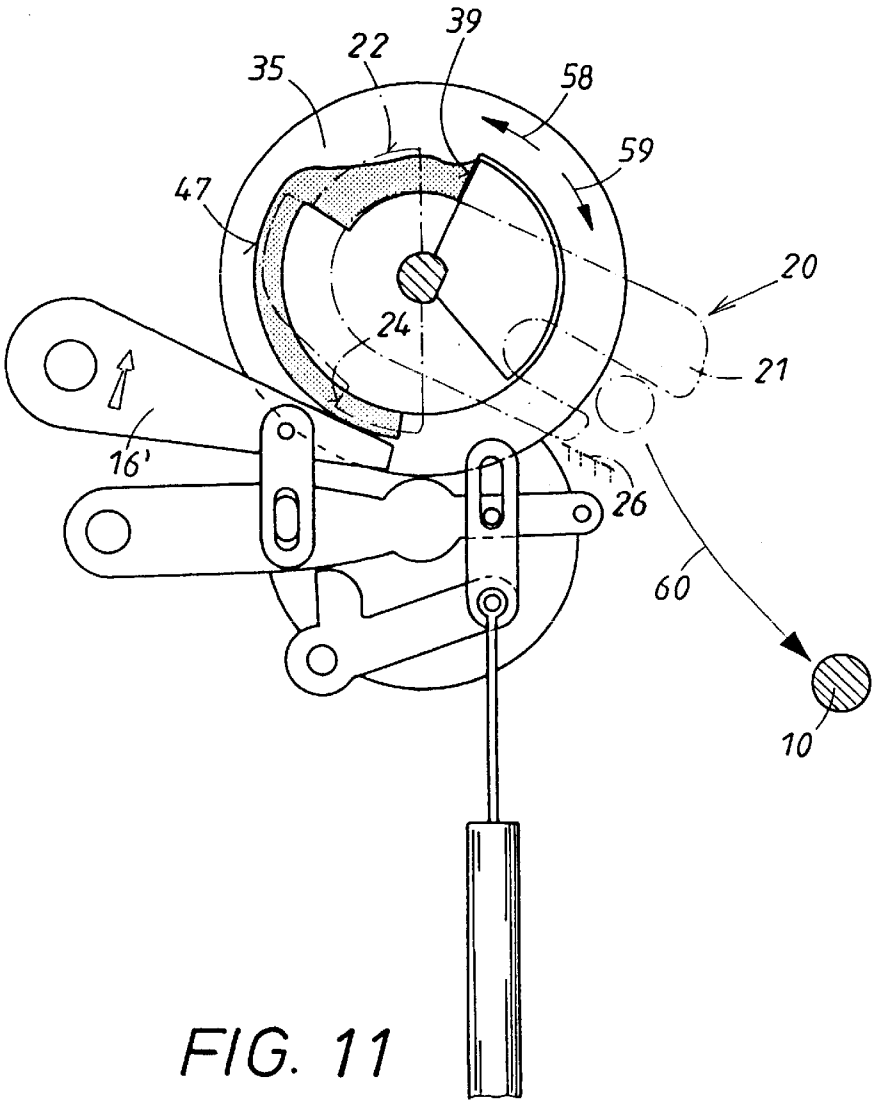
Figure 12:
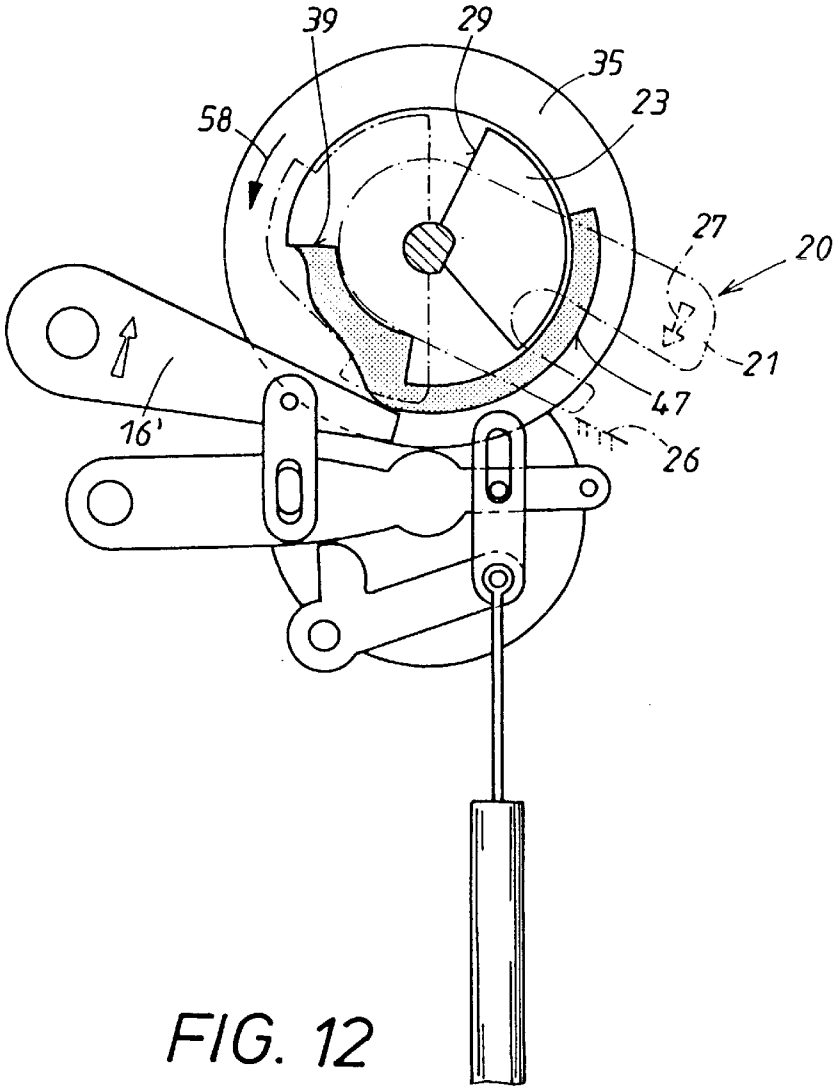

Finally, the rotary unit 20 reaches the initial position shown in FIG. 11 by a motor-driven rotation 59 of the drive member 35. The rotary spagnolet 21 is again moved into its fully open position and releases the locking bolt, as illustrated in FIG. 11 by dash-dotted lines. As illustrated by the movement arrow 60 the locking bolt 10 seated on the flap is moved away so that the flap can again reach its fully open position. On the path into the open pivoted position of FIG. 11 the pre-locking stage 24 of the rotating latch 22 is passed which is however inactive because the locking pawl is still secured by the control surface 47 at the gear mechanism side. Passing across the pre-locking stage 24 is again detected by sensors which in this embodiment of the invention slow the motor 40 and drive it again in the counter direction, i.e., in the closing direction 58. The thus resulting conditions are illustrated in FIG. 12 in an intermediate rotational position of the drive member 35. While the rotary unit 20 is secured by contacting of its rotary spagnolet 21 on the stop 26 as a result of spring action 27, the shoulder 39 of the drive member 35, which was still active previously, is moved away from the counter shoulder 29 of the catch 23. When the drive wheel 35 is driven further in the opening direction 59 by a motor, the still active control surface 47 of FIG. 12 now passes underneath the locking pawl which is still maintained in its inactive position 16'. Finally, the ready position of the drive member 35, as illustrated in FIGS. 4*a,* 4*b,* is reached where the control surface 47 has moved away from the locking pawl 16 and is thus supported on the circumferential surface 42 of the rotating latch 22. The rotating latch is activated and is under pre-stress of the spring load 17. However, in this ready position it cannot yet drop into the locking stages 24 or 25 as long as the pivot position of the rotary unit 20 is present.

Figure 13:
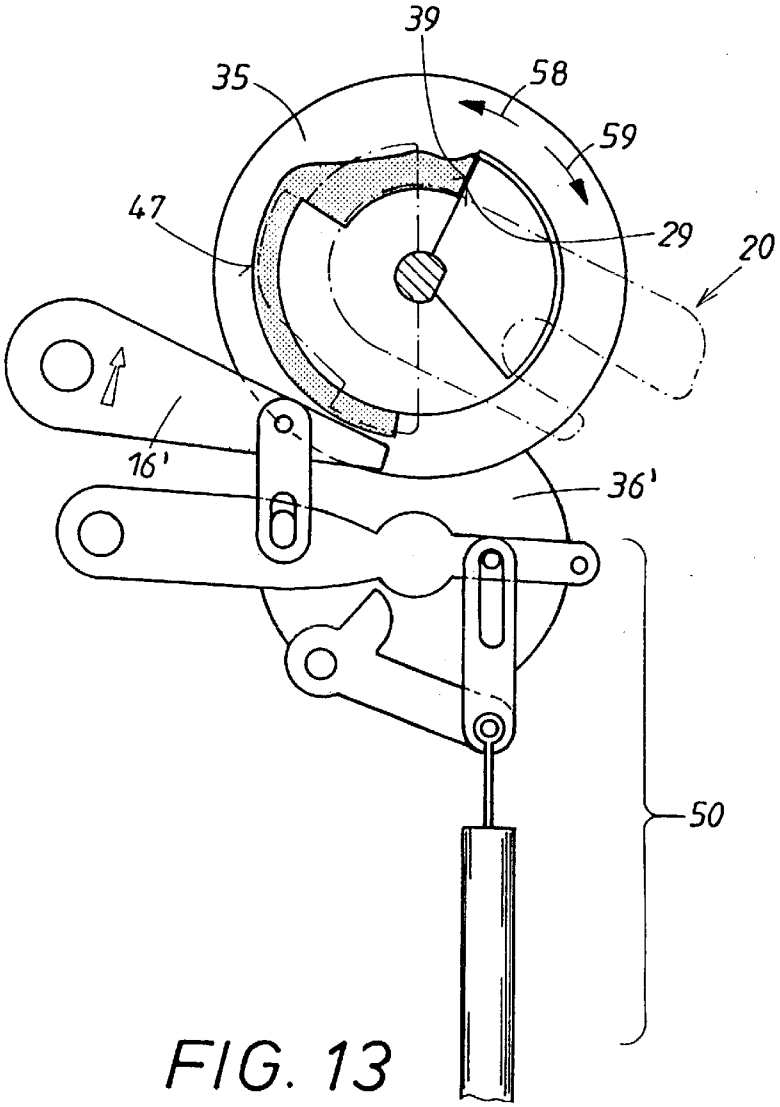
FIG. 13 the same illustration of the lock parts as in FIG. 11 but in an alternative application where, instead of the motor, return springs can return the lock parts again into their ready position for closing the flap according to FIG. 4*b*.

FIG. 13 shows first an emergency actuation which is analog to the conditions described in connection with FIG.

8*b*. While the drive wheel is still in the rotary position illustrated in FIG. 11, it is assumed that the electric power supply or the like fails and an opening or closing 58, 59 without motor driving action is to be performed. The opening is not required in the situation of FIG. 11, but the emergency situation could also result in a preceding rotational position, for example, FIG. 10. In this case, the locking pawl is in its inactive position 16' as a result of the control surface 47, but the already aforementioned self locking action in the gear mechanism 30 would be present, had not the gear group been transferred into the separating position 36' by triggering the actuator 15 in FIG. 13. Since this however can be triggered according to FIG. 13, the pressure contact between the shoulder 39 and the counter shoulder 29 is canceled and the return effect of the above described return spring 54 can become effective. The drive member 35 is transferred by this spring 44 automatically into its ready position according to FIGS. 4*a*, 4*b*. Accordingly, the rotary unit 20 reaches again its open pivot position, if it is not already present, as is the case in FIG. 13.

The triggering of the actuator 50 according to FIG. 13 is also useful when, based on the FIGS. 4*a*, 4*b*, an exclusively manual closing movement 58 is to take place. The rotary unit 20 can be pivoted (58) into the closed position manually by the angular amount 63 indicated in FIG. 4*b*, even though the shoulder 38 at the gear mechanism side impacts on the shoulder 28 of the catch. The free space 48 described in connection with FIG. 4*b* is indeed smaller than the angular amount 63 for the rotational movement of the construction unit 20 out of the open pivot position of FIG. 4*b* into the closed pivot position illustrated by a dotted line and corresponding to FIG. 7. Also, a different operation of the invention is possible. This may reside in that the aforementioned gear group 36 is positioned normally always in the separating position 36' described in connection with FIGS. 3, 8*b* and 13. This initially does not impair the two ready positions for opening according to FIG. 8*a* and for closing according to FIGS. 4*a*, 4*b*, as has been explained before. Only when, based on the ready position for closing according to FIGS. 4*a*, 4*b*, a closing assistance by the motor 40 is desired, this gear group will reach its engagement position 36 so that the operation according to FIGS. 5, 6, 7 is carried out in the already described manner. However, a simplified control then occurs. Once FIG. 7 has been reached, the motor 40 thus stops the closing movement 58 of the drive member 35. Now the gear group 36 is transferred by a suitable control member again into its separating position 36' according to FIG. 3, 8*b*, or 13 where the self locking action in the gear mechanism 30 is canceled. The explained spring forces 27 or the return spring 44 then guides the drive member 35 automatically again into the ready position of FIGS. 8*a*, 8*b* without a current supply of the motor 40 in the opening pivot direction 59 being required. The ready position according to FIG. 8*a* of the drive member 35 is realized by a spring force. Then the locking pawl 16 drops into the final locking position illustrated in FIG. 8*a* and secures the rotary unit 20.

Now the position-changeable gear group 36 can again be transferred automatically into its separating position 36' of FIG. 3, wherein however first the locking pawl remains in its engagement position 16 of FIG. 8*a*. In this connection, a variant relative to the conditions explained in FIG. 8*b* occurs. When now the rotary unit 20 is to be transferred again into the open position according to FIG. 11 of the preceding embodiment, a motor-driven opening movement in the direction of arrow 59 is not required. It is sufficient to transfer the locking pawl 16 by a suitable control member into its inactive position 16' illustrated in FIG. 8*b* where the rotating latch 22 is released. The spring force 27 acting on the rotary unit 20 provides the spring-caused return movement of the rotary unit 20. The described return spring 44 secures the drive member 35 in the ready position already illustrated in FIG. 8, which ready position is identical to FIG. 4*a* and again characterizes the desired ready state for closing. This alternative operation simplifies thus the control of the motor 40.

List of Reference Numerals

| | |
|---|---|
| 10 | closing member, closing bolt |
| 11 | movable flap |
| 12 | stationary compartment rim |
| 13 | axle shaft of 20 |
| 14 | tiltable axle of 36 |
| 15 | movement part of 10 locked position |
| 16 | locking pawl (in engaged position) |
| 16' | inactive position of 16, release position |
| 17 | spring loading arrow of 16 |
| 18 | tilting angle between 36, 36' (FIG. 3) |
| 19 | lock housing |
| 20 | rotary unit |
| 21 | rotary spagnolet of 20 |
| 22 | rotating latch of 20 |
| 23 | catch of 20 |
| 24 | pre-locking stage of 16 |
| 25 | final locking stage of 16 |
| 26 | stop for 21 |
| 27 | spring loading arrow of 21 in the opening pivot direction |
| 28 | first counter shoulder on 22 |
| 29 | second counter shoulder on 22 |
| 30 | gear mechanism |
| 31 | worm gear of 30 |
| 32 | spur gear of 30 |
| 33 | gear of 36 |
| 34 | pinion of 36 |
| 35 | toothed drive member of 30 |
| 36 | position-changeable gear group of 33, 34 (engagement position) |
| 36' | separating position of 36 |
| 37 | cam on 35 |
| 38 | first shoulder on 35 |
| 39 | second shoulder on 35 |
| 40 | motor |
| 41 | worm gear on 40 |
| 42 | peripheral surface of 22 |
| 43 | spring leg of 44 |
| 44 | return spring |
| 45 | pin on 35 (FIG. 2) |
| 46 | pin on 19 (FIG. 2) |
| 47 | radial control surface on 37 |
| 48 | free space between 28, 38 (FIG. 4a) |
| 49 | free space between 29, 39 (FIG. 4b) |
| 50 | actuator |
| 51 | working lever (in the pivoted position) |
| 51' | pivoted-away position of 51 |
| 52 | support lever (in active position) |
| 52' | inactive position of 52 |
| 53 | pull cable of 54, core of 54 |
| 54 | Bowden cable |
| 55 | coupling rod between 51, 52 (FIG. 8a) |
| 56 | coupling rod between 16, 51 (FIG. 8a) |
| 57 | force arrow of the lifting spring for 51 (FIG. 8a) |
| 58 | movement arrow in the closing pivot direction of 20 or 35 |
| 59 | movement arrow in the opening direction of 20 or 35 |
| 60 | movement arrow of 10 in the open position (FIG. 11) |
| 61 | free space between 28, 38 (FIG. 8a) |
| 62 | free space, angle between 29, 39 (FIG. 8) |
| 63 | angular amount for rotational movement of 20 (FIG. 4) |

What is claimed is:

1. A lock for flaps (11) or doors of vehicles, in particular, glove compartment lock, comprising a rotary spagnolet (21) in which, during closing (15) of the flap (11), a locking member (10) is inserted and rotates the rotary spagnolet (21) out of an open pivot position, which corresponds to the open position of the flap, via a split position of the flap into a closed position determining the locked position of the flap, comprising a locking pawl (16) and a rotating latch (22), connected rotationally fixedly to the rotary spagnolet (21), wherein the rotating latch (22) is secured by the locking pawl (16) when the locking pawl (16) is active and when a rotary unit (20), comprised of the rotary spagnolet (21) and the rotating latch (22), has been transferred out of its open pivot position, with the flap in the open position, either into a pre-locking position determining the split position of the flap or into a closed pivot position defining the locked position of the flap, wherein the rotary unit (20) has a rotationally fixed catch (23) with the two counter shoulders (28, 29) oriented in opposite directions relative to one another, wherein the drive member (35) of a gear mechanism (30) driven by a motor (40) has two shoulders (38,39) correlated with the two counter shoulders (28, 29), wherein the motor (40) serves at least as a closing aid or an opening aid, wherein the two shoulders (38; 39) of the drive member (35) impact respectively on the corresponding counter shoulder (28; 29) of the catch (23) and move the rotary unit (20) in the closing pivot direction (58) or in the opening pivot direction (59) to the fully open or closed position which defines the open or closed position of the flap, wherein the drive member (35), in the open or closed position of the flap, is rotated back into a defined ready position for opening or closing the flap, wherein between its shoulders (38) and the counter shoulders (28; 29) of the catch (23) a free space (48, 49; 61, 62) is present which allows a manual movement of the flap, wherein the gear mechanism (30) has a position-changeable (18) gear group (36) which relative to the rest of the gear mechanism is adjustable between an engagement position and a separating position (36'), and wherein the position-changeable gear group (36) is in its separating position (36') at least in an emergency situation and the locking pawl (16) is inactive (16') when the flap is in its closed position and the drive wheel (35) is in a ready position for opening the flap.

2. The lock according to claim 1, wherein, in the closed and open position of the flap, the rotary unit (20) has positions different relative to one another, but the drive wheel (35) is always in the same ready position, and wherein, when the separating position (36') of the gear group (36) is present, a return spring (44) acting on the drive wheel (35) automatically transfers the drive wheel (35) into its ready position.

3. The device according to claim 1, wherein the locking pawl (16) is spring-loaded (17) in the engagement direction, and the drive wheel (35) has a control surface (47) which pushes the locking pawl (16) away from the rotating latch (22) during opening of the flap.

4. The lock according to claim 1, wherein the position-changeable gear group (36) is normally in an engaged position and only in the emergency situation is transferred into its separating position (36'), and the return rotation of the drive member (35) into the ready position for opening or closing is realized by a corresponding return movement of the motor (40).

5. The lock according to claim 1, wherein the position-changeable gear group (36) is normally in its separating position (36') and is transferred into its engagement position only during motor-driven closing or opening of the flap and the return rotation of the drive member (35) into the ready position for opening or closing is realized by the return springs (44).

* * * * *